US007282472B2

(12) United States Patent
Kapur et al.

(10) Patent No.: US 7,282,472 B2
(45) **Date of Patent: *Oct. 16, 2007**

(54) CLEANING COMPOSITION

(75) Inventors: Neha Kapur, Newcastle upon Tyne (GB); Anju Deepali Massey Brooker, Newcastle upon Tyne (GB); James Iain Kinloch, Cramlington (GB); Alison Lesley Main, Whitley Bay (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/274,428

(22) Filed: Nov. 15, 2005

(65) Prior Publication Data

US 2006/0079425 A1 Apr. 13, 2006

Related U.S. Application Data

(62) Division of application No. 10/294,736, filed on Nov. 14, 2002, now Pat. No. 6,998,375.

(30) Foreign Application Priority Data

Nov. 14, 2001 (GB) ..... 0127281.4
Feb. 28, 2002 (GB) ..... 0204700.9

(51) Int. Cl.

| | |
|---|---|
| ***C11D 3/08*** | (2006.01) |
| ***C11D 3/10*** | (2006.01) |
| ***C11D 3/37*** | (2006.01) |
| ***C11D 3/34*** | (2006.01) |
| ***B08B 3/04*** | (2006.01) |

(52) U.S. Cl. ..... 510/220; 510/221; 510/224; 510/227; 510/230; 510/232; 510/233; 510/439; 510/441; 510/446; 510/466; 510/475; 510/507; 510/509; 510/511; 510/514; 510/523; 134/25.2; 134/25.3; 134/39; 134/40; 134/42

(58) Field of Classification Search ..... 510/220, 510/221, 224, 227, 230, 232, 283, 439, 441, 510/446, 466, 475, 507, 509, 511, 514, 523; 134/25.2, 25.3, 39, 40, 42

See application file for complete search history.

(56) References Cited

U.S. PATENT DOCUMENTS

| | | | | |
|---|---|---|---|---|
| 4,776,455 | A | 10/1988 | Anderson et al. | |
| 5,547,612 | A | 8/1996 | Austin et al. | |
| 5,958,855 | A * | 9/1999 | Binstock et al. | 510/224 |
| 6,172,020 | B1 | 1/2001 | Binstock et al. | |
| 6,191,088 | B1 | 2/2001 | Binstock et al. | |
| 6,475,977 | B1 | 11/2002 | Pfeiffer et al. | |
| 6,492,312 | B1 * | 12/2002 | Pfeiffer et al. | 510/221 |
| 6,521,576 | B1 * | 2/2003 | Ghatlia et al. | 510/229 |
| 6,878,679 | B2 | 4/2005 | Sommerville-Roberts et al. | |
| 6,998,375 | B2 * | 2/2006 | Kapur et al. | 510/220 |
| 7,022,659 | B2 | 4/2006 | Duquet et al. | |

FOREIGN PATENT DOCUMENTS

| | | |
|---|---|---|
| EP | 0 712 810 A2 | 5/1996 |
| EP | 0 851 022 A2 | 7/1998 |
| EP | 0 712 810 B1 | 5/2000 |
| EP | 1 111 037 B1 | 3/2003 |
| FR | 2802548 | 6/2001 |
| JP | 11021586 A | 1/1999 |
| WO | WO 00/14258 | 3/2000 |
| WO | WO 01/72941 A1 | 10/2001 |
| WO | WO 01/83657 A2 | 11/2001 |
| WO | WO 01/83668 A1 | 11/2001 |
| WO | WO 01/96514 A1 | 12/2001 |
| WO | WO 03/006594 A1 | 1/2003 |

* cited by examiner

*Primary Examiner*—Brian Mruk
(74) *Attorney, Agent, or Firm*—Laura R. Grunzinger

(57) ABSTRACT

An automatic dishwashing composition in unit dose form for delivery into the main-wash cycle of an automatic dishwashing machine, the composition comprising a phosphate or non-phosphate detergency builder and a sulfonated anti-scaling polymer.

15 Claims, No Drawings

CLEANING COMPOSITION

This application is a divisional application of U.S. patent application Ser. No. 10/294,736, filed Nov. 14, 2002, now U.S. Pat. No. 6,998,375, which claims priority to UK patent application Serial No. GB 0127281.4 filed Nov. 14, 2001.

TECHNICAL FIELD

The present invention is in the field of dishwashing. In particular, it relates to dishwashing compositions and products in unit dose form. Particularly, it relates to dishwashing compositions and products in unit dose form comprising an anti-scaling polymer. The compositions and products provide excellent shine benefits.

BACKGROUND OF THE INVENTION

Polyphosphates are desirable components in automatic dishwashing detergent compositions, they are very effective scale inhibitors, however they suffer one main drawback. Polyphosphates will over time hydrolyze to orthophosphate. Orthophosphate does not function as a scale inhibitor and will actually form scale with calcium (calcium phosphate). A similar problem occurs when the washing liquor contains high level of calcium or the liquor is otherwise underbuilt. Scale deposits not only give rise to filming and spotting on the dishware/tableware but also on the interior of the dishwashing machine, especially on the heater element (hydrolysis is favoured at high temperature), negatively influencing the efficiency of the dishwashing process.

Carbonates are also common components in automatic dishwashing detergent compositions, which can also give rise to scale problems and therefore, filming and spotting on the washed articles. Traditionally, the filming and spotting problems have been ameliorated by the use of salt in order to soften the water (that is to reduce the concentration of cations, specially $Ca^{2+}$ and $Mg^{2+}$) and by the use of rinse aid containing sequestrant, dispersant and surfactant which to some extent help to control the hardness of the ions present in the water and to reduce the surface tension of the dishwashing liquor, thus avoiding the formation of liquid droplets and allowing uniform drying of the washed utensils, ameliorating filming and spotting issues.

The use of sulfonated polymers to reduce scale formation in automatic dishwashing is known in the art. In EP-A-851,022 a polymer comprising an olefinically unsaturated carboxylic acid monomer and at least one monomer unit selected from copolymerizable sulfonated monomers, copolymerizable non-ionic monomer and mixtures thereof is used in a rinse composition for inhibiting scale. EP-A-1,111,037 describes a detergent tablet having two separate regions, one of the regions comprises materials that delays dissolution, said region can further comprise an anti-scalant agent.

WO-A-01/72941 discloses an automatic dishwashing composition comprising a detergency builder and at least one polymer comprising carboxylate groups and sulfonate groups. U.S. Pat. No. 6,191,088 discloses a powdered automatic dishwashing composition comprising a polymer containing sulfonic acid groups.

Traditionally, the machine dishwashing process involves the steps of dosing detergent into the dispenser at the beginning of each wash and filling the salt and rinse aid reservoirs at intervals are required. Some users may find it inconvenient to carry out all these steps and prefer a simpler process involving the use of a single product performing all the functions required for the dishwashing process. Unitised doses of dishwashing detergents are found to be more attractive and convenient to some consumers, additionally they avoid the need of the consumer to measure the product thereby giving rise to a more precise dosing and avoiding wasteful overdosing or underdosing. For this reason automatic dishwashing detergent products in tablet form have become very popular. Detergent products in pouch form are also known in the art.

The detergent dishwashing product is usually placed inside the dispenser and released during the main-wash cycle of the dishwashing process. However, the dispensers of some dishwashing machines are not completely water tight, mainly for two reasons, either the dispenser has some apertures allowing water ingress or the dispenser is sealed with a rubber band that can deform with time due to the high temperature of the dishwashing process. Water ingress into the dispenser can cause premature leaking of dishwashing product which is thus lost after the pre-rinse. This problem is especially acute in the case of liquid compositions having a low viscosity wherein a considerable amount of the product can be lost before the main-wash cycle. In the case of solid compositions water leaking into the dispenser can also be a problem, leading for example to the caking of the composition or to the lost of activity of some ingredients, such as bleach.

SUMMARY OF THE INVENTION

The present invention relates to built automatic dishwashing compositions and products in unit dose form comprising a sulfonated anti-scaling polymer and means for delivering the sulfonated polymer into the main-wash cycle of an automatic dishwashing machine. It has been found that builder-containing compositions which deliver certain levels of sulfonated anti-scaling polymer into the main-wash liquor are effective in inhibiting the formation of calcium phosphate and calcium carbonate scale with consequent reduction of filming of the washed articles and improved shine.

Thus according to a first aspect of the invention there is provided an automatic dishwashing composition in unit dose form for delivery into the main-wash cycle of an automatic dishwashing machine, the composition comprising a phosphate or non-phosphate detergency builder and an amount of a sulfonated anti-scaling polymer sufficient to provide at least about 80 ppm, preferably at least about 100 ppm, more preferably at least about 125 ppm, even more preferably at least about 140 ppm and especially at least about 160 ppm of polymer by weight of the wash liquor.

According to another aspect of the invention there are provided automatic dishwashing compositions and products in unit dose form comprising the anti-scaling polymer together with a carbonate source and an alkaline silicate in defined proportions to provide optimum cleaning and finishing benefits. Preferably the carbonate source and alkaline silicate are in a weight ratio of at least about 3, preferably at least about 3.5, more preferably at least about 4 and even more preferable at least about 4.5. The weight ratio of carbonate source to sulfonated anti-scaling polymer, on the other hand is preferably at least about 4, more preferably at least about 6. Unit dose products will also normally include a means for delivering the sulfonated polymer into the main-wash cycle of an automatic dishwashing machine. These formulations provide not only excellent cleaning and finishing benefits but also excellent glass, china and porcelain care. Carbonate is an excellent builder, bleaching source and alkalinity source, providing good hydrolysis of soil.

Additionally it is a very attractive ingredient from the cost point of view. Although all these properties contribute to the overall performance, carbonate precipitation can occur in dishware/tableware. However, it has now been found that even at high levels of carbonate, the sulfonated polymer in a weight ratio as defined acts to prevent or minimize carbonate deposit formation. The hydrolysis of food solids can give rise to bulky pieces of soils that can deposit on dishware/tableware, however, these deposits are also minimized or avoided by the presence of the sulfonated polymer.

The alkalinity provided from the carbonate can make dishware/tableware more prone to corrosion, especially materials containing silicate such as glass, china and porcelain. The silica lattice can be leached as consequence of hydrolysis of the Si—O—Si bonds and also metal ions can be leached from the glass structure. Corrosion creates an uneven surface and this can change the way that the light is reflected from glass to the detriment of the shine of the surface. It has been found that when the anti-scaling polymer is used in combination with a carbonate source:alkaline silicate ratio of at least about 3, preferably at least about 3.5, more preferably at least about 4 and even more preferably at least about 4.5 is added to the detergent composition, glass, china and porcelain corrosion is minimized or precluded as well as colour fading. At the same time excellent finishing results are achieved.

The carbonate source can be selected from compounds containing carbonate or compounds which give rise to carbonate under the wash conditions. Preferred sources of carbonate are alkali metal carbonates, bicarbonates, percarbonates and mixtures thereof. In preferred embodiments, compositions and products of the invention comprise from about 6 to about 50%, preferably from about 10 to about 40% of carbonate source by weight of composition.

The alkaline silicate is preferably free of metasilicate. Preferred are silicates wherein the ratio of $SiO_2$ to the alkali metal oxide ($M_2O$, where M=alkali metal) is typically from about 1.8 to about 3, preferably from about 2 to about 2.4. Compositions for use herein preferably comprise alkaline silicates in a level from about 2% to about 20%, preferably from about 3 to about 10% by weight of the composition and are free of metasilicate.

Optimum cleaning and filming benefits are obtained when the builder and the polymer are in a weight ratio of from about 5:1 to about 15:1. The term "builder" as used herein includes sequestering (e.g., phosphates and citrates) and precipitating builders (e.g., carbonates) but excludes materials that function primarily as alkalis such as caustic soda, caustic potash and alkaline silicates such as sodium metasilicate and amorphous silicates having an $SiO_2$ to $Na_2O$ ratio of greater than 1. As discussed above, the compositions of the invention may however comprise alkali metal silicates in order to provide protection against corrosion of metals and against attack on dishware, including china and glassware, and for pH control, although the compositions are preferably free of metasilicates. Metasilicates give rise to high pH compositions which can be aggressive, producing corrosion and attacking the dishware/tableware. Preferably, the composition has a pH in the wash liquor of from about 9 to about 11, preferably from about 10 to about 10.8.

The cleaning and finishing performance achieved with the composition of the invention can be boosted by the incorporation of detergency enzymes, preferably proteases. They provide significant benefits on protein soil removal especially on egg and starchy soils. Thus the benefits on filming provided by the sulfonate polymer and the benefits on spotting provided by the detergency enzymes synergistically combine to provide extraordinary shine benefits. Thus, according to another aspect of the invention, there is provided a composition comprising a sulfonated anti-scaling polymer; a detergency enzyme; and means for delivering the sulfonated polymer and detergency enzyme, either simultaneously or sequentially, into the main wash cycle of an automatic dishwashing machine. In a preferred embodiment, the enzyme is a proteolytic enzyme. Amylotic enzyme is also preferred for use herein.

Due to the excellent properties of the polymer the absolute amount of detergent used in the dishwashing process may be reduced without loosing cleaning and finishing performance. Thus, in a preferred aspect of the invention there is provided a unit dose form adapted to provide from about 10 to about 40 g, preferably from about 12 to about 25 g and especially from about 15 to about 22 g of the dishwashing detergent composition into the main-wash cycle of a dishwashing machine. Preferably the polymer is present in the dishwashing composition in a level from about 3% to about 6% by weight of the composition.

An automatic dishwashing operation typically comprises three or more cycles: a pre-wash cycle, a main-wash cycle and one or more rinse cycles. In Europe, the pre-wash cycle, when used, is typically a cold water cycle lasting about 6 or 7 min. In the main-wash cycle the water comes in cold and is heated up to about 55 or 65° C., the cycle lasting about 20 min. Rinsing usually comprises two or more separate cycles following the main wash, the first being cold and lasting between about 2 to 5 min, the second one starting cold with heat-up to about 65° C. or 70° C. and lasting about 20 min. The dishwashing machine is filled with cold water at the start of each cycle and emptied at the end of each cycle through a filter. Most of the detergent dishwashing ingredients are formulated to work more efficiently during the main-wash cycle, due to the temperature and duration of the cycle. The detergent for the main-wash is placed into the dispenser which is automatically open at the start of the main-wash. However, the design of some dispensers include some apertures which allow water ingress, other dispensers becomes less water-tight due to tear and wear. The fact that the dispensers are not water-tight may give rise to different issues. Firstly, detergent may leak out before the main wash cycle, secondly, some of the detergent ingredients may loose activity before delivery into the wash solution and thirdly, especially in the case of solid compositions, sticking and caking problems can arise. In view of the preceding issues it is desirable to protect the dishwashing detergent at least until the main-wash cycle as discussed in detail below.

Suitable unit dose forms for use herein include single and multi-compartment pouches, capsules and ampoules. Preferred for use herein are pouches, both single and multi-compartment. For purposes of achieving phased or sequential delivery of detergent actives, it is preferred that at least two of the compartments of a multi-compartment pouch have a different disintegration rate or dissolution profile under in-use conditions. Film solubility can be controlled by for example pH, temperature, ionic strength or any other means.

Suitable for use herein are products in unit dose form which are substantially insoluble in cold water and soluble in warm water in order to protect the detergent during the pre-wash cycle and to release it during the main-wash cycle. The unit dose form can be designed to be placed into the dispenser of the dishwashing machine or alternatively it can be designed to be placed outside the dispenser of the dishwashing machine, for example in the cutlery basket, in a net or on the door or on the floor of the dishwasher. In a preferred embodiment the protection of the dishwashing detergent is achieved by making one or more pouch compartments of a film material which is substantially insoluble in cold water (i.e., at or below about 20° C.) and soluble in warm water (i.e., at or above about 30° C., preferably above about 40° C.). In a preferred embodiment, from viewpoint of phased or sequential delivery of detergent actives, at least one of the compartments is made of a material which is substantially insoluble in cold water at or below about 20° C. and soluble in warm water at or above about 30° C. and at least one other compartment is made of a material which is soluble in cold water at or below 20° C. Alternatively, the whole pouch can be made of a material which is substantially insoluble in cold water but soluble in warm water.

Preferably the film material has a water solubility according to the hereinbelow defined test of less than about 50%, more preferably less than about 20% and especially less than about 5% under cold water conditions (20° C. or below) when exposed to the water for at least 10 minutes, preferably at least 15 minutes; and a water solubility of at least about 50%, more preferably at least about 75% and especially at least about 95% under warm water conditions (30° C. or above, preferably 40° C. or above) when exposed to the water for about 5 minutes and preferably when exposed to the water for about 3 minutes. Such film materials are herein referred to as being substantially insoluble in cold water but soluble in warm water. Sometimes this is abbreviated simply to "warm water soluble". Apart from providing phased release, this kind of material also solves the problem of gelling of the pouch material when handling it with wet hands.

50 grams±0.1 gram of pouch material is added in a pre-weighed 400 ml beaker and 245 ml±1 ml of distilled water is added. This is kept at the desired temperature, by using a water bath, and stirred vigorously on a magnetic stirrer set at 600 rpm, for the desired time. Then, the mixture is filtered through a folded qualitative sintered-glass filter with a maximum pore size of 20 μm. The water is dried off from the collected filtrate by any conventional method, and the weight of the remaining material is determined (which is the dissolved or dispersed fraction). Then, the % solubility or dispersability can be calculated.

Pouches suitable for use herein can be in the form of a single-compartment pouch wherein the pouch content can be in the form of a liquid, gellable liquid, paste, gel, liquid-solid suspension, loose powder, densified powder, compacted powder (e.g, spheres, noodles, etc), tablet or mixtures thereof. Single compartment pouches are very attractive from the viewpoint of process simplicity.

Alternatively, the pouch of the invention can be a multi-compartment pouch. Such pouches are especially useful for delivering ingredients in different physical forms, for allowing delayed or sequential release effects and for separating incompatible detergent ingredients during storage or during the dishwashing process. Preferred embodiments for use herein are multi-compartment pouches having at least two compartments which present different disintegration rates or disintegration profiles. In a preferred embodiment, there is provided a multi-compartment pouch comprising a first compartment comprising a liquid composition and a second compartment comprising a solid composition. Preferably, the liquid compartment is made of a warm water-soluble material as described hereinabove and the solid compartment is made of cold water-soluble material, i.e., a material which is soluble to an extent of at least 50%, preferably at least 75%, more preferably at least 95% by weight under cold water conditions (20° C. or below) when exposed to the water for about 5 minutes and preferably when exposed to the water for about 3 minutes. Due to the way in which European dishwashing machines operate (they are filled with cold water and the cold water is heated by means of a heater), the compartment made of warm water-soluble material takes longer to dissolve than the compartment made of cold water-soluble material. This kind of pouch allows for a delayed release of the liquid composition providing optimised use of the detergent composition. Preferred for use herein are pouches in which the liquid and solid detergent composition are in a weight ratio of from about 1:30 to about 30:1, preferably from about 1:1 to 1:25 and more preferably from about 1:15 to about 1:20. In a preferred embodiment, the liquid composition comprises the anti-scaling polymer, the delayed release of the polymer being beneficial for enhancing the film-prevention. The anti-scaling polymer in powder form is highly hygroscopic, therefore it can pick up water from the environment and from other components of the formulation. When the polymer picks up water it becomes crystalline and the dissolution kinetics decrease, furthermore water pick up can give rise to pouch and composition stability issues. These problems can be overcome by introducing the polymer in liquid form into the liquid-containing compartment. Also preferred are liquid compositions comprising detergency enzyme, this being advantageous from the enzyme storage stability viewpoint, the enzyme being separated from the bleach and from highly alkaline materials contained in the solid composition. Furthermore, the liquid containing compartment (substantially cold water-insoluble and warm water-soluble) will take longer to dissolve or disintegrate than the solid containing compartment (cold water-soluble), minimizing the negative interaction in the wash liquor between bleach and enzymes and between surfactant and enzymes and providing improved protein soil removal and spotting benefits in the later stages of the dishwashing process.

The interaction of the negatively charged polymer with surfactants, especially with positively charged or semi-polar surfactants, such as for example amine oxides, can give rise to the formation of coacervates which decrease the activity and therefore the cleaning and finishing performance providing by both materials; therefore, it is desirable to place the surfactant and the polymer in different compartments. Pouch compartments containing solid compositions, in particular oxygen bleach comprising compositions, are usually pin-pricked in order to allow the leakage of any formed oxygen. The holes formed by pin pricking also allow the leakage of perfumes or malodors, however. For example, surfactants often have an unpleasant smell associated with them and when such pouches are packed within a secondary package, the unpleasant surfactant smell can be concentrated into the package head space and released each time that the user open the package. This problem can be avoided by including the surfactant in the liquid composition, since liquid containing compartments must be made free of pin holes. Thus, according to another embodiment, the liquid composition comprises a surfactant. Another advantage of having the surfactant in the liquid phase is to avoid problems of loading the surfactant onto the solid material. A further advantage is that the surfactant is released with a certain delay with respect to the solid composition, this allows better performance of the bleach and enzymes which can be adversely affected by interaction between the surfactant and the table/dishware surfaces.

Preferably perfume is introduced in the solid composition, pin prickling allowing for slow release of the perfume before the product is used in the dishwasher.

In another preferred embodiment, there is provided an automatic dishwashing product in the form of a multi-compartment pouch, capsule or ampoule for delivery into the main-wash cycle of an automatic dishwashing machine and which comprises a unit dose of an automatic dishwashing composition comprising a phosphate or non-phosphate detergency builder and a sulfonated anti-scaling polymer, and wherein the dishwashing product includes at least two compartments having a different disintegration rate or dissolution profile under in-use conditions and wherein said compartment having the slower disintegration or dissolution rate incorporates the anti-scaling polymer. Preferably the product further comprises a detergency enzyme, preferably a proteolytic enzyme, at least a portion of which is incorporated with the anti-scaling polymer in the slower disintegrating or dissolving compartment. It is also preferred that the anti-scaling polymer is present in an amount sufficient to provide a concentration of at least about 80 ppm, preferably at least about 100 ppm, more preferably at least about 125 ppm, even more preferably at least about 140 ppm and especially at least about 160 ppm in the wash liquor. Preferably, the polymer is present in a level from about 3% to about 6% by weight of the composition, the polymer and builder are in a weight ratio of from about 5:1 to about 15:1 and the pH of the product in the wash liquor is of from about 9 to about 11, preferably from about 10 to about 10.8.

Due to the anti-scaling properties provided by the compositions and products of the invention the use of salt is not required and due to the shine benefits the use of rinse aid is not required either. Thus, according to another aspect of the invention, the use of the composition or product for washing tableware/cookware in an automatic dishwashing machine, in which no rinse aid and no salt is used is provided. The composition of the invention not only provides improved shine on the washed tableware/cookware but also prevents scale deposition on dishwashing parts, especially on the heating element which is more prone to scale formation, due to the fact that high temperature favours the formation of phosphate and carbonate scale. The problem with scale deposits on the heater is not only the aesthetic effect but also the fact that the heat transfer coefficient between the heater element and the water decreases and consequently the efficiency of the water heating and dishwashing process also decreases.

According to another aspect of the invention, there is provided a method of washing tableware/cookware in an automatic dishwashing machine consisting of treating the tableware/cookware with the composition or product of the invention. In a preferred embodiment, a pouch or other unit dose comprising the compositions of the invention is delivered into the main-wash cycle via the dispenser of the dishwasher.

DETAILED DESCRIPTION OF THE INVENTION

The present invention envisages automatic dishwashing compositions and products in unit dose form comprising a sulfonated anti-scaling polymer for delivery into the main wash cycle. The compositions and products provide shine benefits and avoid the use of salt and rinse aid. The invention also provides methods and uses of the compositions and products.

Sulfonated Anti-Scaling Polymer

An essential component of the composition of the invention is a sulfonated anti-scaling polymer. The composition of the invention comprises form about 3 to 6%, preferably from about 3.5 to about 5% by weight of the composition of the polymer. The polymer generally comprises from about 0.1% to about 90%, preferably from about 1% to about 30% by weight of a sulfonic acid containing monomer. Examples of sulfonate monomers include, but are not limited to, allyl hydroxypropanyl sulfonate ethers, allylsulfonic acids, methallylsulfonic acids, styrene sulfonic acids, vinyl toluene sulfonic acids, acrylamido alkane sulfonic acids, allyloxybenzene sulfonic acids, 2-alkylallyloxybenzene sulfonic acids such as 4-sulfophenol methallyl ether, and the alkali or alkaline earth metal or ammonium salts thereof.

Suitable examples of scale-inhibiting copolymers include, but are not limited to tetrapolymers of 4-sulfophenol methallyl ether, sodium methallyl sulfonate, acrylic acid and methyl methacrylate. The monomer unit, sulfophenol methallyl ether, has the formula:

$$CH_2{=}C(CH_3)CH_2OC_6H_4SO_3M$$

where M represents hydrogen, alkali metal, alkaline earth metal or ammonium ions.

Other suitable examples of scale-inhibiting copolymers include, but are not limited to, a copolymer of acrylic acid and 4-sulfophenol methallyl ether; a copolymer of acrylic acid and 2-acrylamido-2-methylpropane sulfonate; a terpolymer of acrylic acid, 2-acrylamido-2-methylpropane sulfonate and sodium styrene sulfonate; a copolymer of acrylic acid and vinyl pyrrolidone; a copolymer of acrylic acid and acrylamide; and a polymer of sulfophenyl methallyl ether, sodium methallyl sulfonate, acrylic acid, methyl methacrylate and 2-acrylamido-2-methyl propane sulfonic acid. Preferably, the polymer is the tetrapolymer of 4-sulfophenol methallyl ether, sodium methallyl sulfonate, acrylic acid and methyl methacrylate. Preferred for use herein are copolymers comprising polyacrylic acid, methyl methacrylate, sulfophenol methallyl ether and sodium methallyl sulfonate.

Preferred commercial available copolymers include: Alcosperse 240, Aquatreat AR 540 and Aquatreat MPS supplied by Alco Chemical; Acumer 3100 and Acumer 2000 supplied by Rohm & Haas; Goodrich K-798, K-775 and K-797 supplied by BF Goodrich; ACP 1042 supplied by ISP technologies Inc.; and polyacrylic acid/acrylamide supplied by Aldrich. A particularly preferred copolymer is Alcosperse 240 supplied by Alco Chemical.

Warm Water-Soluble Pouch Material

The pouch material is such as to allow the delivery of the sulfonated polymer into the main wash cycle, for example, a material which is insoluble in water at or below about 20° C. and soluble or dispersible in water at or above about 30° C. as described hereinabove. Besides thermodynamic solubility characteristics, the dissolution kinetics of the film and its mechanical stability also play a significant role on the present invention. Preferred for use herein are commercially available polyvinyl alcohols (PVA) obtained by hydrolysis of polyvinyl acetates. The solubility of these films can be selectively adjusted by the degree of hydrolysis of the PVA or by using a cross-linking agent. Examples of commercially available PVA suitable for use herein are BP26 available from Aicello, L10 and L15 available from Aquafilm, VF-M and VM-S available from Kuraray and E-2060 available from Monosol, especially preferred for use herein is BP26 available from Aicello. The thickness of the film can influence the dissolution kinetics, films having a thickness between about 10 and about 100 μm being preferred for use herein.

Other preferred materials for use herein are starch, starch derivatives, cellulose and cellulose derivatives, more especially methyl cellulose and mixture thereof. Especially preferred for use herein are polymers comprising hydroxypropylmethylcellulose.

Surfactant

In the compositions and methods of the invention the detergent surfactant is preferably low foaming by itself or in combination with other components (i.e. suds suppressers). Surfactants suitable herein include anionic surfactants such as alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and sulfosuccinates, wherein the alkyl, alkenyl or acyl moiety is $C_5$-$C_{20}$, preferably $C_{10}$-$C_{18}$ linear or branched; cationic surfactants such as chlorine esters (U.S. Pat No. 4,228,042, U.S. Pat. No. 4,239,660 and U.S. Pat. No. 4,260,529) and mono $C_6$-$C_{16}$ N-alkyl or alkenyl ammonium surfactants wherein the remaining N positions are substituted by methyl, hydroxyethyl or hydroxypropyl groups; low and high cloud point nonionic surfactants and mixtures thereof including nonionic alkoxylated surfactants (especially ethoxylates derived from $C_6$-$C_{18}$ primary alcohols), ethoxylated-propoxylated alcohols (e.g., BASF Poly-Tergent® SLF18), epoxy-capped poly(oxyalkylated) alcohols (e.g., BASF Poly-Tergent® SLF18B—see WO-A-94/22800), ether-capped poly(oxyalkylated) alcohol surfactants, and block polyoxyethylene-polyoxypropylene polymeric compounds such as PLURONIC®, REVERSED PLURONIC®, and TETRONIC® by the BASF-Wyandotte Corp., Wyandotte, Mich.; amphoteric surfactants such as the $C_{12}$-$C_{20}$ alkyl amine oxides (preferred amine oxides for use herein include $C_{12}$ lauryldimethyl amine oxide, $C_{14}$ and $C_{16}$ hexadecyl dimethyl amine oxide), and alkyl amphocarboxylic surfactants such as Miranol™ C2M; and zwitterionic surfactants such as the betaines and sultaines; and mixtures thereof. Surfactants suitable herein are disclosed, for example, in U.S. Pat. No. 3,929,678, U.S. Pat. No. 4,259,217, EP-A-0414 549, WO-A-93/08876 and WO-A-93/08874. Surfactants are typically present at a level of from about 0.2% to about 30% by weight, more preferably from about 0.5% to about 10% by weight, most preferably from about 1% to about 5% by weight of composition. Preferred surfactant for use herein are low foaming and include low cloud point nonionic surfactants and mixtures of higher foaming surfactants with low cloud point nonionic surfactants which act as suds suppresser therefor.

Builder

Builders suitable for use in detergent and cleaning compositions herein include builder which forms water-soluble hardness ion complexes (sequestering builder) such as citrates and polyphosphates e.g. sodium tripolyphosphate and sodium tripolyphosphate hexahydrate, potassium tripolyphosphate and mixed sodium and potassium tripolyphosphate salts and builder which forms hardness precipitates (precipitating builder) such as carbonates e.g. sodium carbonate. The builder is typically present at a level of from about 30 to about 80%, preferably from about 40 to about 70% by weight of composition. It is also preferred that the ratio of sequestering builder to precipitating builder is from about 10:1 to about 1:1, preferably from about 8:1 to 2:1.

Silicates

Silicates suitable for use herein include partially water-soluble or insoluble builders such as crystalline layered silicates (EP-A-0164514 and EP-A-0293640) and aluminosilicates inclusive of Zeolites A, B, P, X, HS and MAP.

Amorphous sodium silicates having an $SiO_2$:$Na_2O$ ratio of from 1.8 to 3.0, preferably from 1.8 to 2.4, most preferably 2.0 can also be used herein although highly preferred from the viewpoint of long term storage stability are compositions containing less than about 22%, preferably less than about 15% total (amorphous and crystalline) silicate.

Enzyme

Preferred enzymes for use herein are proteolitic enzymes such as Esperase®, Alcalase®, Durazym® and Savinase® (Novo) and Maxatase®, Maxacal®, Properase® and Maxapem® (Gist-Brocades). Other enzymes suitable for use herein include bacterial and fungal cellulases such as Carezyme and Celluzyme (Novo Nordisk A/S); peroxidases; lipases such as Amano-P (Amano Pharmaceutical Co.), M1 Lipase® and Lipomax® (Gist-Brocades) and Lipolase® and Lipolase Ultra® (Novo); cutinases; α and β amylases such as Purafect Ox Am® (Genencor) and Termamyl®, Ban®, Fungamyl®, Duramyl®, and Natalase® (Novo); pectinases; and mixtures thereof. Enzymes are preferably added herein as prills, granulates, or cogranulates at levels typically in the range from about 0.0001% to about 2% pure enzyme by weight of composition.

Bleaching Agent

Bleaching agents suitable herein include chlorine and oxygen bleaches, especially inorganic perhydrate salts such as sodium perborate mono- and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from about 1% to about 40% by weight, preferably from about 2% to about 30% by weight and more preferably from abut 5% to about 25% by weight of composition. Preferred for use herein, as part of the carbonate source, is sodium percarbonate. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from about 0.5% to about 25%, preferably from about 1% to about 10% by weight of composition while the preformed organic peroxyacids themselves are typically incorporated at levels in the range from 0.5% to 25% by weight, more preferably from 1% to 10% by weight of composition. Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes(U.S. Pat. No. 4,810,410).

Low Cloud Point Non-Ionic Surfactants and Suds Suppressers

The suds suppressers suitable for use herein include nonionic surfactants having a low cloud point. "Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer, pp. 360-362). As used herein, a "low cloud point" nonionic surfactant is defined as a nonionic surfactant system ingredient having a cloud point of less than 30° C., preferably less than about 20° C., and even more preferably less than about 10° C., and most preferably less than about 7.5° C. Typical low cloud point nonionic surfactants include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic surfactants include, for example, ethoxylated-propoxylated alcohol (e.g., BASF Poly-Tergent® SLF18) and epoxy-capped poly(oxyalkylated) alcohols (e.g., BASF Poly-Tergent® SLF18B series of nonionics, as described, for example, in U.S. Pat. No. 5,576,281).

Preferred low cloud point surfactants are the ether-capped poly(oxyalkylated) suds suppresser having the formula:

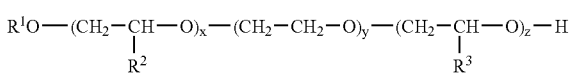

wherein $R^1$ is a linear, alkyl hydrocarbon having an average of from about 7 to about 12 carbon atoms, $R^2$ is a linear, alkyl hydrocarbon of about 1 to about 4 carbon atoms, $R^3$ is a linear, alkyl hydrocarbon of about 1 to about 4 carbon atoms, x is an integer of about 1 to about 6, y is an integer of about 4 to about 15, and z is an integer of about 4 to about 25.

Other low cloud point nonionic surfactants are the ether-capped poly(oxyalkylated) having the formula:

$$R_I O(R_{II}O)_n CH(CH_3)OR_{III}$$

wherein, $R_I$ is selected from the group consisting of linear or branched, saturated or unsaturated, substituted or unsubstituted, aliphatic or aromatic hydrocarbon radicals having from about 7 to about 12 carbon atoms; $R_{II}$ may be the same or different, and is independently selected from the group consisting of branched or linear $C_2$ to $C_7$ alkylene in any given molecule; n is a number from 1 to about 30; and $R_{III}$ is selected from the group consisting of:

(i) a 4 to 8 membered substituted, or unsubstituted heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

(b) provided that when $R^2$ is (ii) then either: (A) at least one of $R^1$ is other than $C_2$ to $C_3$ alkylene; or (B) $R^2$ has from 6 to 30 carbon atoms, and with the further proviso that when $R^2$ has from 8 to 18 carbon atoms, R is other than $C_1$ to $C_5$ alkyl.

Other suitable components herein include organic polymers having dispersant, anti-redeposition, soil release or other detergency properties invention in levels of from about 0.1% to about 30%, preferably from about 0.5% to about 15%, most preferably from about 1% to about 10% by weight of composition. Preferred anti-redeposition polymers herein include acrylic acid containing polymers such as Sokalan PA30, PA20, PA15, PA10 and Sokalan CP10 (BASF GmbH), Acusol 45N, 480N, 460N (Rohm and Haas), acrylic acid/maleic acid copolymers such as Sokalan CP5 and acrylic/methacrylic copolymers. Preferred soil release polymers herein include alkyl and hydroxyalkyl celluloses (U.S. Pat. No. 4,000,093), polyoxyethylenes, polyoxypropylenes and copolymers thereof, and nonionic and anionic polymers based on terephthalate esters of ethylene glycol, propylene glycol and mixtures thereof.

Heavy metal sequestrants and crystal growth inhibitors are suitable for use herein in levels generally from about 0.005% to about 20%, preferably from about 0.1% to about 10%, more preferably from about 0.25% to about 7.5% and most preferably from about 0.5% to about 5% by weight of composition, for example diethylenetriamine penta(methylene phosphonate), ethylenediamine tetra(methylene phosphonate)hexamethylenediamine tetra(methylene phosphonate), ethylene diphosphonate, hydroxy-ethylene-1,1-diphosphonate, nitrilotriacetate, ethylenediaminotetracetate, ethylenediamine-N,N'-disuccinate in their salt and free acid forms.

The compositions herein can contain a corrosion inhibitor such as organic silver coating agents in levels of from about 0.05% to about 10%, preferably from about 0.1% to about 5% by weight of composition (especially paraffins such as Winog 70 sold by Wintershall, Salzbergen, Germany), nitrogen-containing corrosion inhibitor compounds (for example benzotriazole and benzimadazole—see GB-A-1137741) and Mn(II) compounds, particularly Mn(II) salts of organic ligands in levels of from about 0.005% to about 5%, preferably from about 0.01% to about 1%, more preferably from about 0.02% to about 0.4% by weight of the composition.

Other suitable components herein include colorants, water-soluble bismuth compounds such as bismuth acetate and bismuth citrate at levels of from about 0.01% to about 5%, enzyme stabilizers such as calcium ion, boric acid, propylene glycol and chlorine bleach scavengers at levels of from about 0.01% to about 6%, lime soap dispersants (see WO-A-93/08877), suds suppressors (see WO-93/08876 and EP-A-0705324), polymeric dye transfer inhibiting agents, optical brighteners, perfumes, fillers and clay.

Liquid detergent compositions can contain low quantities of low molecular weight primary or secondary alcohols such as methanol, ethanol, propanol and isopropanol can be used in the liquid detergent of the present invention. Other suitable carrier solvents used in low quantities includes glycerol, propylene glycol, ethylene glycol, 1,2-propanediol, sorbitol and mixtures thereof.

Pouch

Unitised dose forms especially useful for use herein are pouches. The pouch herein is typically a closed structure which preferably comprises two or more compartments, made of materials described herein. Subject to the constraints of dispenser fit, the pouch can be of any form, shape and material which is suitable to hold the composition, e.g. without allowing the release of the composition from the pouch prior to contact of the pouch to water. The exact execution will depend on, for example, the type and amount of the composition in the pouch, the number of compartments in the pouch, the characteristics required from the pouch to hold, protect and deliver or release the composition and/or components thereof.

The composition, or components thereof, are contained in the internal volume space of the pouch, and are typically separated from the outside environment by a barrier of water-soluble material. Typically, different components of the composition contained in different compartments of the pouch are separated from one another by a barrier of water-soluble material.

In the case of multi-compartment pouches, the compartments may be of a different colour from each other, for example a first compartment may be green or blue, and a second compartment may be white or yellow. One compartment of the pouch may be opaque or semi-opaque, and a second compartment of the pouch may be translucent, transparent, or semi-transparent. The compartments of the pouch may be the same size, having the same internal volume, or may be different sizes having different internal volumes.

For reasons of deformability and dispenser fit under compression forces, pouches or pouch compartments containing a component which is liquid will usually contain an air bubble having a volume of up to about 50%, preferably up to about 40%, more preferably up to about 30%, more preferably up to about 20%, more preferably up to about 10% of the volume space of said compartment.

The pouch is preferably made of a pouch material which is soluble or dispersible in water under warm water conditions, and preferably has a water-solubility of at least 50%, preferably at least 75% or even at least 95%, as measured by the method set out herein above.

Preferred pouch materials are polymeric materials, preferably polymers which are formed into a film or sheet. The pouch material can, for example, be obtained by casting, blow-moulding, extrusion or blow extrusion of the polymeric material, as known in the art.

Preferred polymers, copolymers or derivatives thereof suitable for use as pouch material are selected from polyvinyl alcohols, partially hydrolysed polyvinylacetates, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, hydroxybutyl methylcellulose, maltodextrin, polymethacrylates, and most preferably selected from polyvinyl alcohols, polyvinyl alcohol copolymers, partially hydrolysed polyvinylacetates and hydroxypropyl methyl cellulose (HPMC), hydroxybutyl methylcellulose (HBMC), and combinations thereof. Preferably, the level of polymer in the pouch material, for example a PVA polymer, is at least 60%.

The polymer can have any weight average molecular weight, preferably from about 1000 to 1,000,000, more preferably from about 10,000 to 300,000 yet more preferably from about 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000.

Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol.

Preferred for use herein are polymers inclusive of polyvinylacetate which are from about 60% to about 98% hydrolysed, preferably about 80% to about 90% hydrolysed, to improve the dissolution characteristics of the material.

Most preferred cold water-soluble pouch materials are PVA films known under the trade reference Monosol M8630, as sold by Chris-Craft Industrial Products of Gary, Ind., US, and PVA films of corresponding solubility and deformability characteristics. Other films suitable for use herein include films known under the trade reference PT film or the K-series of films supplied by Aicello, or VF-HP film supplied by Kuraray.

The pouch material herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

The pouch can be prepared according to methods known in the art. The pouch is typically prepared by first cutting an appropriately sized piece of pouch material, preferably the pouch material. The pouch material can then be folded to form the necessary number and size of compartments and the edges are sealed using any suitable technology, for example heat sealing, wet sealing or pressure sealing. Preferably, a sealing source is brought into contact with the pouch material, heat or pressure is applied and the pouch material is sealed.

The pouch material is typically introduced to a mould and a vacuum applied so that the pouch material is flush with the inner surface of the mould, thus forming a vacuum formed indent or niche in said pouch material. This is referred to as vacuum-forming.

Another suitable method is thermo-forming. Thermo-forming typically involves the step of forming an open pouch in a mould under application of heat, which allows the pouch material to take on the shape of the mould.

Typically more than one piece of pouch material is used for making multi-compartment pouches. For example, a first piece of pouch material can be vacuum pulled into the mould so that said pouch material is flush with the inner walls of the mould. A second piece of the pouch material can then be positioned such that it at least partially overlaps, and preferably completely overlaps, with the first piece of pouch material. The first piece of pouch material and second piece of pouch material are sealed together. The first piece of pouch material and second piece of pouch material can be made of the same type of material or can be different types of material.

In a preferred process, a piece of pouch material is folded at least twice, or at least three pieces of pouch material are used, or at least two pieces of pouch material are used wherein at least one piece of pouch material is folded at least once. The third piece of pouch material, or a folded piece of pouch material, creates a barrier layer that, when the sachet is sealed, divides the internal volume of said sachet into at least two or more compartments.

The pouch can also be prepared by fitting a first piece of the pouch material into a mould, for example the first piece of film may be vacuum pulled into the mould so that said film is flush with the inner walls of the mould. A composition, or component thereof, is typically poured into the mould. A pre-sealed compartment made of pouch material, for example containing a liquid composition, is then typically placed over the mould containing the composition, for example a solid composition, or component thereof. The pre-sealed compartment preferably contains a composition, or component thereof. The pre-sealed compartment and said first piece of pouch material may be sealed together to form the pouch.

EXAMPLES

Abbreviations Used in Examples

In the examples, the abbreviated component identifications have the following meanings:

Carbonate: Anhydrous sodium carbonate

STPP: Sodium tripolyphosphate anhydrous

Silicate: Amorphous Sodium Silicate ($SiO_2$:$Na_2O$=from 2:1 to 4:1)

Alcosperse 240: Sulfonated polymer available from Alco Chemical, 40-45% solids

Alcosperse 240-D: Sulfonated polymer available from Alco Chemical 95% solids

Percarbonate: Sodium percarbonate of the nominal formula $$2Na_2CO_3.3H_2O_2$$

TAED: Tetraacetylethylenediamine

Amylase: α-amylase available from Novo Nordisk A/S

Protease: protease available from Novo Nordisk A/S

SLF18: low foaming surfactant available from BASF

LF404: low foaming surfactant available from BASF $C_{14}$AO: tetradecyl dimethyl amine oxide $C_{16}$AO: hexadecyl dimethyl amine oxide DPG: dipropylene glycol In the following examples all levels are quoted in grams.

Examples 1 to 3

The compositions of examples 1 to 3 are enclosed in a single compartment PVA pouch made of a substantially cold water-insoluble and warm water-soluble film, BP26 as supplied by Aicello.

| | Example | | |
|---|---|---|---|
| | 1 | 2 | 3 |
| STPP | 9.0 | 9.0 | 9.0 |
| Silicate | 1.0 | 1.0 | 1.0 |
| Carbonate | 2.0 | 2.0 | 2.0 |
| Alcosperse 240-D | 1.0 | 1.0 | 1.0 |
| $C_{16}$AO | 0.2 | | |
| $C_{14}$AO | | 0.2 | |
| SLF18 | 1.0 | 1.0 | |
| LF404 | | | 0.6 |
| Percarbonate | 2.5 | 2.5 | 2.5 |
| TAED | 0.25 | 0.25 | 0.25 |
| Amylase | 0.4 | 0.4 | 0.4 |
| Protease | 0.8 | 0.8 | 0.8 |
| Perfume | 0.05 | 0.05 | 0.05 |
| Water | balance | balance | balance |

-continued

| | Example | | |
|---|---|---|---|
| | 1 | 2 | 3 |
| Total | 20.0 g | 20.0 g | 19.55 g |

8 Libby glasses and a beaker containing 50 g of the soil described hereinbelow are placed into a Bosch Siemens 6032 dishwashing machine having a 5 l wash water capacity. The water used has a hardness of 18-22 gpg of Calcium. One of each of the exemplified pouches is placed in the dispenser for delivery in the main wash and the dishwashing machine is operated in its normal 65° C. program. The washed glasses present excellent shine.

| Soil: | |
|---|---|
| Ingredients | |
| Crisp and Dry solid oil | 300 g +/− 1 g |
| Scott's Oatmeal | 100 g +/− 1 g |
| Stork Margarine | 150 g +/− 1 g |
| Caged Medium Egg Yolk (Separate the yolks and wash in cold City [medium hard] water before use). | 300 g +/− 1 g |
| Defrosted Asda Frozen Spinach (Sieve before use to remove excess water). | 100 g +/− 1 g |
| Asda UHT full fat milk | 50 g +/− 1 g |

The soil is prepared by blending the above ingredients together for 10 mins.

Examples 4 to 8

The compositions of examples 4 to 8 are made in the form of two compartment PVA pouches. The first compartment comprising the liquid composition is substantially cold water-insoluble and warm water-soluble and is made from a BP26 film as supplied by Aicello, the second compartment comprising the solid composition is cold water-soluble and is made from a Monosol M8630 film as supplied by Chris-Craft Industrial Products.

| | Example | | | | |
|---|---|---|---|---|---|
| | 4 | 5 | 6 | 7 | 8 |
| Solid composition | | | | | |
| STPP | 10.0 | 10.0 | 10.0 | 10.5 | 9.5 |
| Silicate | 1.0 | 1.0 | 1.0 | 1.0 | 1.0 |
| Carbonate | 2.0 | 2.0 | 2.0 | 2.0 | 2.5 |
| Alcosperse 240 | | | 1.0 | 1.0 | 1.0 |
| $C_{16}$AO | 0.2 | | | | |
| $C_{14}$AO | | | | | |
| SLF18 | 1.0 | | | | |
| LF404 | | | | | |
| PCO | 2.5 | 2.5 | 2.5 | 2.5 | 2.5 |
| TAED | 0.25 | 0.25 | 0.25 | 0.25 | 0.25 |
| Amylase | 0.4 | | 0.4 | 0.4 | 0.4 |
| Protease | 0.8 | 0.8 | 0.8 | 0.8 | 0.8 |
| Perfume | 0.05 | 0.05 | 0.05 | 0.05 | 0.05 |
| Total | 18.15 g | 16.6 g | 19.15 g | 19.65 g | 19.15 g |
| Liquid composition | | | | | |
| DPG | 0.8 | 0.5 | 0.75 | 0.75 | 0.8 |
| $C_{16}$AO | | | 0.2 | | |

-continued

| | Example | | | | |
|---|---|---|---|---|---|
| | 4 | 5 | 6 | 7 | 8 |
| $C_{14}AO$ | | | | 0.2 | |
| SLF18 | | | 1.0 | 1.0 | |
| LF404 | | | | | 0.8 |
| Alcosperse 240-D | 1.0 | 1.0 | | | |
| Amylase | | 0.4 | | | |
| Dye | 0.1 | 0.1 | 0.05 | 0.05 | 0.1 |
| Total | 1.9 g | 2.0 g | 2.0 g | 2.0 g | 1.7 g |

The dishwashing process of Examples 1 to 3 is repeated. The washed glasses present excellent shine.

Examples 9 to 13

Two-compartment substantially cold water-insoluble and warm water-soluble pouches are made (both compartments) from a BP26 film comprising the compositions of Examples 4 to 8. The pouches are used to wash the load described in Examples 1 to 3. The dishwashing process of Examples 1 to 3 is repeated but placing the pouch in the cutlery basket. The washed glasses present excellent shine.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. An automatic dishwashing product in the form of a multi-compartment pouch, capsule or ampoule wherein the pouch, capsule or ampoule comprises a first compartment comprising a liquid composition, the liquid composition comprising a sulfonated anti-scaling polymer; a second compartment comprising a solid composition, the solid composition comprising a phosphate or non-phosphate detergency builder.

2. An automatic dishwashing composition-of claim 1 wherein the sulfonated anti-scaling polymer is present in an amount from 3% to 6% by weight of the composition.

3. An automatic dishwashing composition according to claim 1 wherein the second composition further comprises a carbonate source wherein the carbonate source is selected from the group consisting of carbonate, bicarbonate, percarbonate and mixtures thereof and wherein the silicate is free of metasilicate.

4. An automatic dishwashing composition according to claim 2 wherein the builder and the polymer are in a weight ratio of from about 5:1 to about 15:1.

5. An automatic dishwashing composition according to claim 2 further comprising a detergency enzyme.

6. The automatic dishwashing product of claim 1 wherein the liquid composition further comprises a detergent enzyme.

7. An automatic dishwashing composition according to claim 6 wherein the detergency enzyme is a proteolytic enzyme.

8. An automatic dishwashing composition according to claim 2 wherein the unit dose form is adapted to provide from about 10 to about 40 g of the dishwashing detergent composition into the main wash cycle of a dishwashing machine.

9. An automatic dishwashing product according to claim 1 wherein at least two of the compartments have a different disintegration rate or dissolution profile under in-use conditions.

10. An automatic dishwashing product according to claim 9 wherein at least one of the compartments is made of a material which is substantially insoluble in cold water at or below about 20° C. and soluble in warm water at or above about 30° C. and wherein at least one other compartment is made of a material which is soluble in cold water at or below 20° C.

11. An automatic dishwashing product according to claim 1 wherein the liquid and solid compositions are in a weight ratio of from about 1:30 to about 30:1.

12. An automatic dishwashing product according to claim 1 wherein the liquid composition comprises a surfactant.

13. The automatic dishwashing product of claim 3 wherein the weight ratio of carbonate source to sulfonated anti-scaling polymer is about 4.

14. The automatic dishwashing product of claim 3 wherein the solid composition further comprises a alkaline silicate.

15. The automatic dishwashing product of claim 14 wherein the carbonate source: alkaline silicate ratio is about 4.5.

* * * * *